US007946597B2

(12) United States Patent
Wan

(10) Patent No.: US 7,946,597 B2
(45) Date of Patent: May 24, 2011

(54) ROLLER SKATE FRAME

(75) Inventor: Fong-Chou Wan, Tainan (TW)

(73) Assignee: Nordica S.p.A., Giavera Del Montello(TV) (IT)

( * ) Notice: Subject to any disclaimer, the term of this patent is extended or adjusted under 35 U.S.C. 154(b) by 432 days.

(21) Appl. No.: 12/082,731

(22) Filed: Apr. 15, 2008

(65) Prior Publication Data

US 2009/0256322 A1 Oct. 15, 2009

(51) Int. Cl.
*A63C 17/04* (2006.01)
*A63C 1/00* (2006.01)

(52) U.S. Cl. ..... 280/11.221; 280/11.19; 280/843; 280/11.227; 280/11.231; 280/11.27; 280/11.3

(58) Field of Classification Search ..... 280/11.12, 280/11.19, 844, 11.14, 11.15, 11.221, 11.223, 280/11.226, 11.227, 11.231, 11.233, 11.25, 280/11.27, 11.3

See application file for complete search history.

(56) References Cited

U.S. PATENT DOCUMENTS

| | | | | |
|---|---|---|---|---|
| 6,588,771 | B2 * | 7/2003 | Olson et al. | 280/11.221 |
| 6,648,344 | B2 * | 11/2003 | Grande | 280/11.221 |
| 6,848,694 | B2 * | 2/2005 | Benoit | 280/11.221 |
| 6,921,093 | B2 * | 7/2005 | Svensson et al. | 280/11.224 |
| 2001/0040351 | A1 * | 11/2001 | Cheatham et al. | 280/11.231 |
| 2004/0041359 | A1 * | 3/2004 | Im | 280/11.25 |

FOREIGN PATENT DOCUMENTS

| | | |
|---|---|---|
| DE | 102 35 223 A1 | 2/2004 |
| FR | 2 768 064 A1 | 3/1999 |

* cited by examiner

*Primary Examiner* — J. Allen Shriver, II
*Assistant Examiner* — John R Olszewski
(74) *Attorney, Agent, or Firm* — Sughrue Mion, PLLC

(57) ABSTRACT

The present invention relates to a roller skate frame. The roller skate frame includes a plate being pressing molded into a main frame of the roller skate comprising two wheel-mounting plates corresponding to each other, and a front bottom connecting face and a shoe-mounting plate connecting thereto. The front bottom connecting face and the shoe-mounting plate are spaced apart with a suitable distance. Further, the front bottom connecting plate is formed by an upper and a lower bridging plate corresponding to each other, and both of which are positioned with a fastener hole respectively.

1 Claim, 8 Drawing Sheets

ROLLER SKATE FRAME

BACKGROUND OF THE INVENTION

1. Field of the Invention

The present invention relates to a roller skate frame, more particularly to a roller skate frame with plate being folded by press molding at one time forming different height of front and rear parts of the plate.

2. Description of the Related Art

FIGS. 1 and 1-1, illustrate a conventional roller skate frame (1) of roller skate. A pair of wheel-mounting plates (11) are folded vertically with right angle, wherein the front and the rear connecting sections forms a front connecting face (12) and a rear shoe mounting plate (13). However, the aforesaid conventional roller skate frame is disadvantageous in that the front and the rear connecting face (12, 13) are in the same height which does not match the human engineering design.

FIGS. 2, 2-1 and 3 illustrate another conventional roller skate frame (2), wherein a pair of wheel-mounting plates (21) is bending inward forming a front connecting face (23). The gap between the wheel-mounting plates (21) of the end section is placed with a fastening plate (22) to engage with the roller skate frame (2) by adapting nuts and rivets to form a rear connecting face (24). However, the aforesaid conventional roller skate frame has the disadvantages as follows. Firstly, two wheel-mounting plates (21) of the roller skate frame (2) have to be mounted to each other with the fastening plate (22) for presenting lower front connecting face (23) and higher rear connecting face (24) which would need extra material, cost more money and consume more time on the assembling process. Secondly, the fastening plate (22) makes more material in need of being cut off for forming the roller skate frame (2) which would cause more wastes.

SUMMARY OF THE INVENTION

The present invention relates to a roller skate frame which is capable of overcoming the disadvantages of the prior arts.

According to the present invention, there is provided a roller skate frame that comprises: two wheel-mounting plates corresponding to each other having upper and lower bridging plates extending inwardly from the front end of the wheel-mounting plates and each of which defines a fastener hole on it. Two bending lines respectively locating on the adjunction between the bridging plates and the front part of the roller skate frames are parallel to the bending lines respectively provided on the rear connecting face of the wheel-mounting plates. The overlap between the upper and lower bridging plates allows the width of the front connecting face being the same as the rear shoe-mounting plate and forms the lower front and higher rear connecting face with different height.

BRIEF DESCRIPTION OF THE DRAWINGS

FIG. 1-1 is a side view of the roller skate frame according to the preferred embodiment of the prior art.

FIG. 2-1 is a side view of side view of the roller skate frame according to the preferred embodiment of the second prior art.

FIG. 6-1 is a perspective bottom view of the bended roller skate frame according to the preferred embodiment of the present invention.

FIG. 7-1 is a front view of the first combination of the bridging plates with the wheel-mounting plates according to the preferred embodiment of the present invention.

FIG. 8-1 is a front view of the second combination of the bridging plates with the wheel-mounting plates according to the preferred embodiment of the present invention.

DETAILED DESCRIPTION OF THE PREFERRED EMBODIMENT

Figure 1:
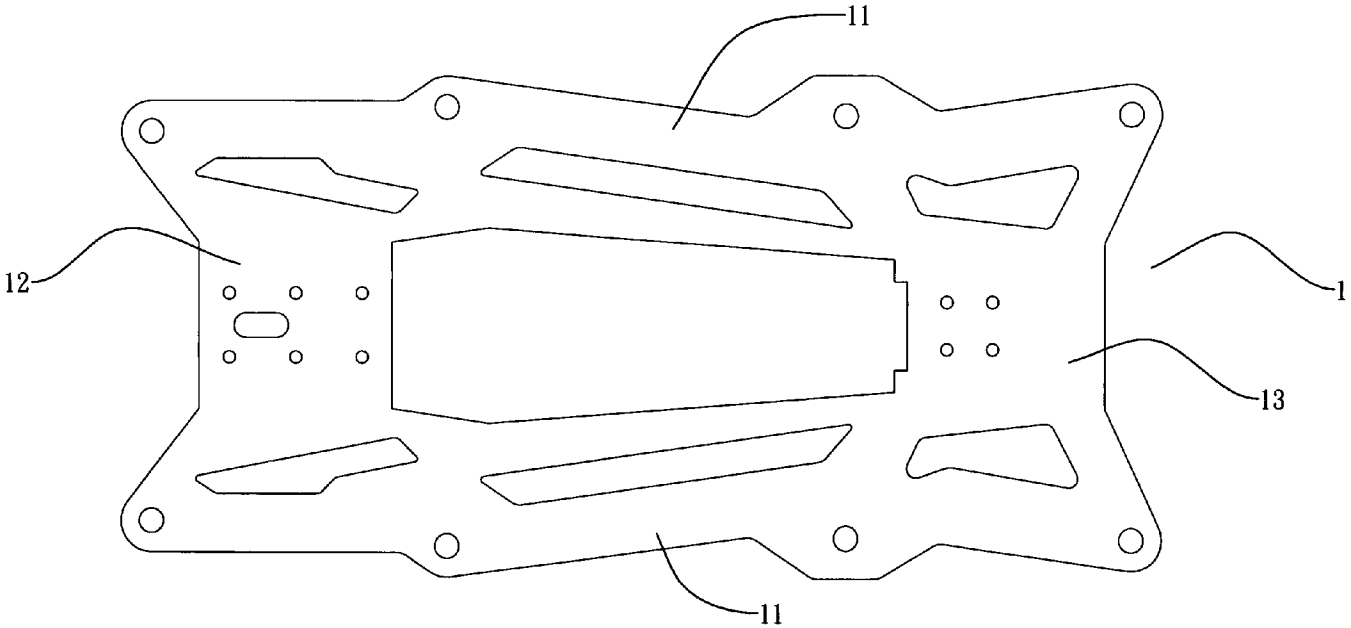
Fig. 1 PRIOR ART
FIG. 1 is an exploded view of a roller skate frame of a preferred embodiment of the prior art.
Figure 1:
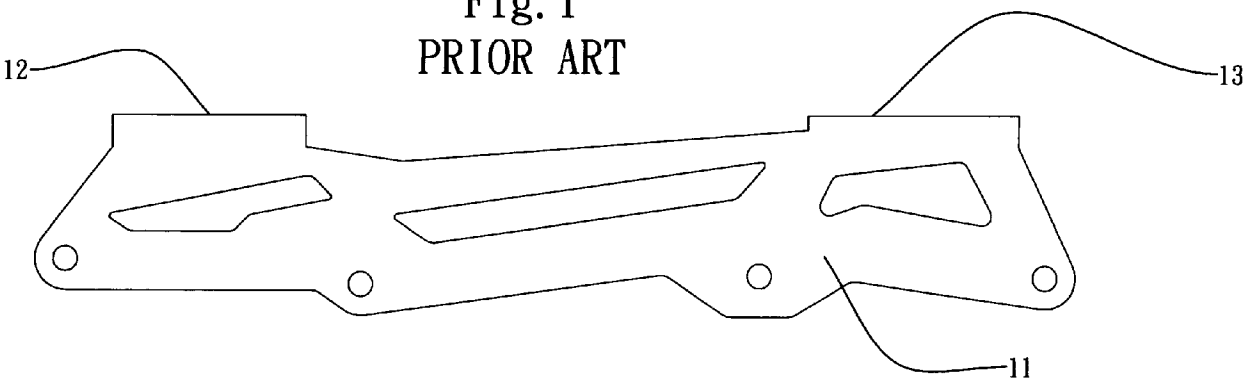
Fig. 1-1 PRIOR ART
Figure 2:
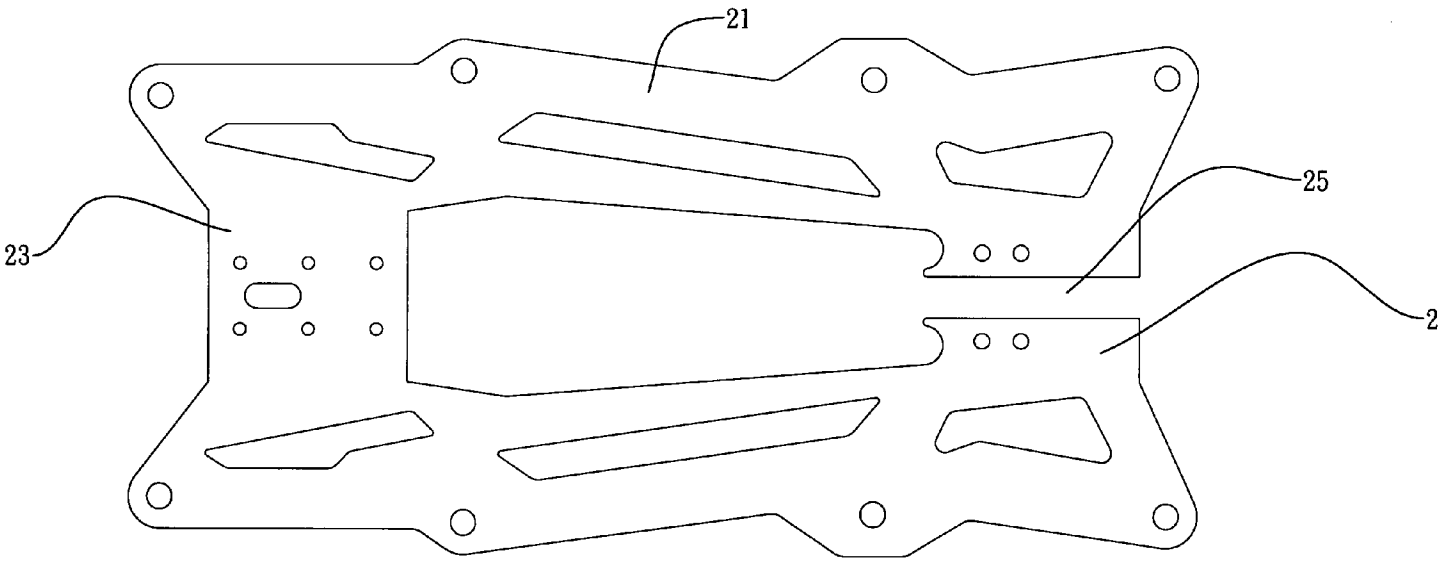
Fig. 2 PRIOR ART
FIG. 2 is an exploded view of a roller skate frame according to the preferred embodiment of the second prior art.
Figures 1, 2:
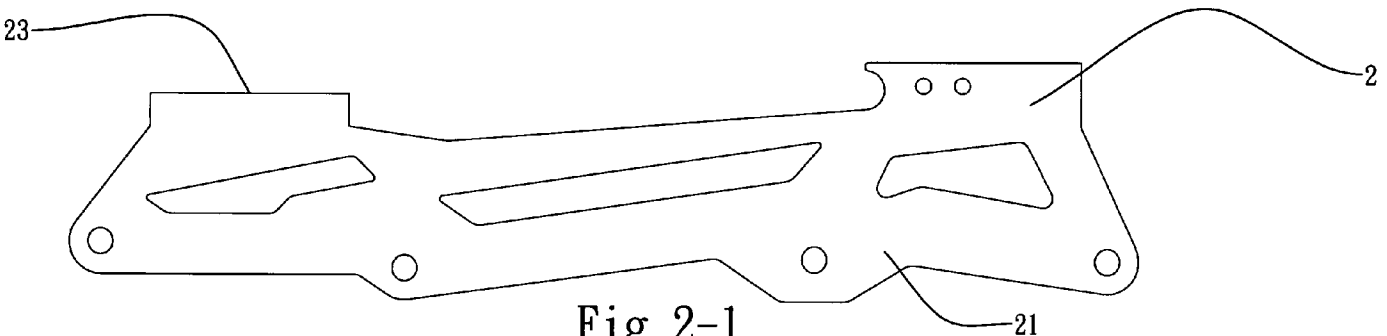
Fig. 2-1 PRIOR ART
Figure 3:
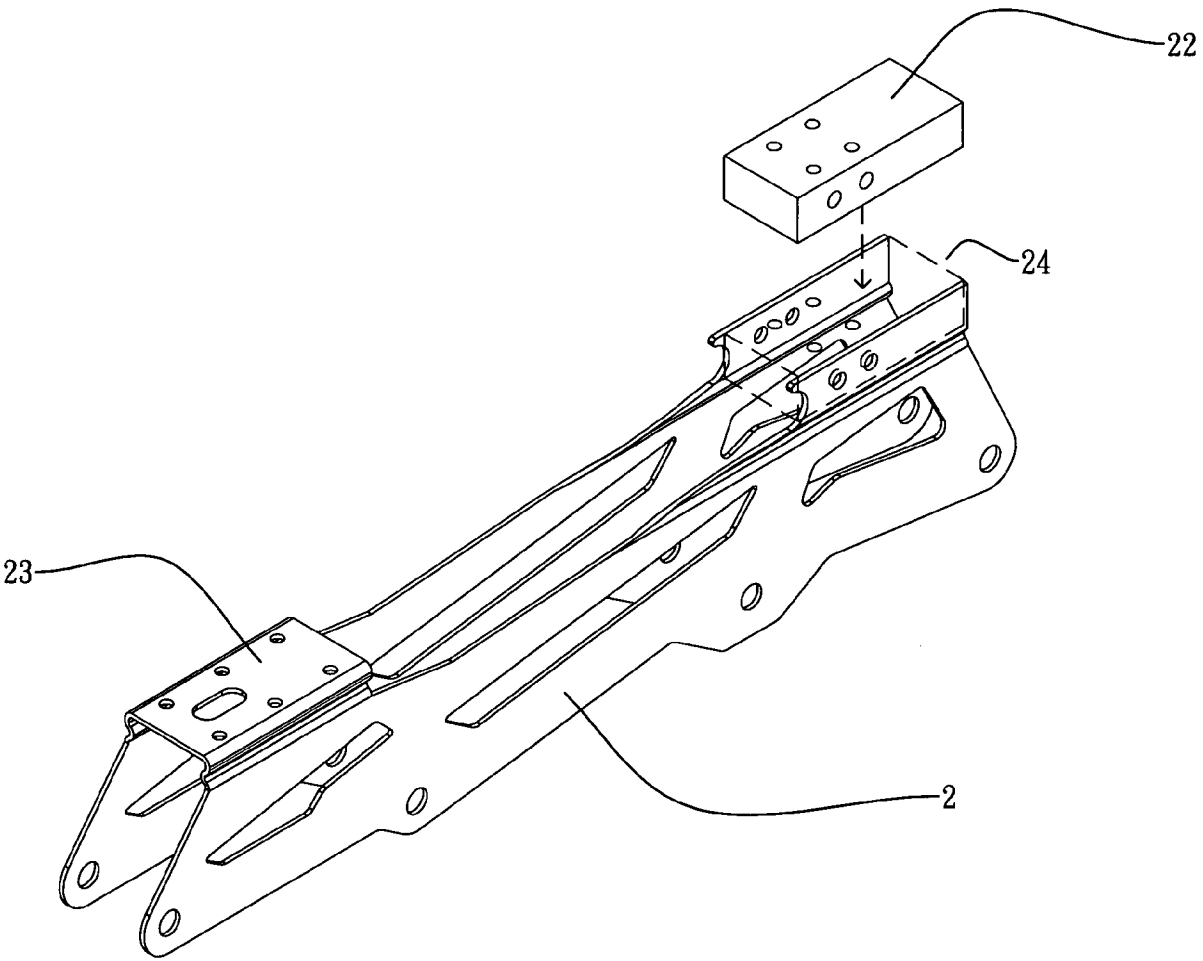
Fig. 3 PRIOR ART
FIG. 3 is a perspective view of the roller skate frame according to the preferred embodiment of the second prior art.
Figure 4:
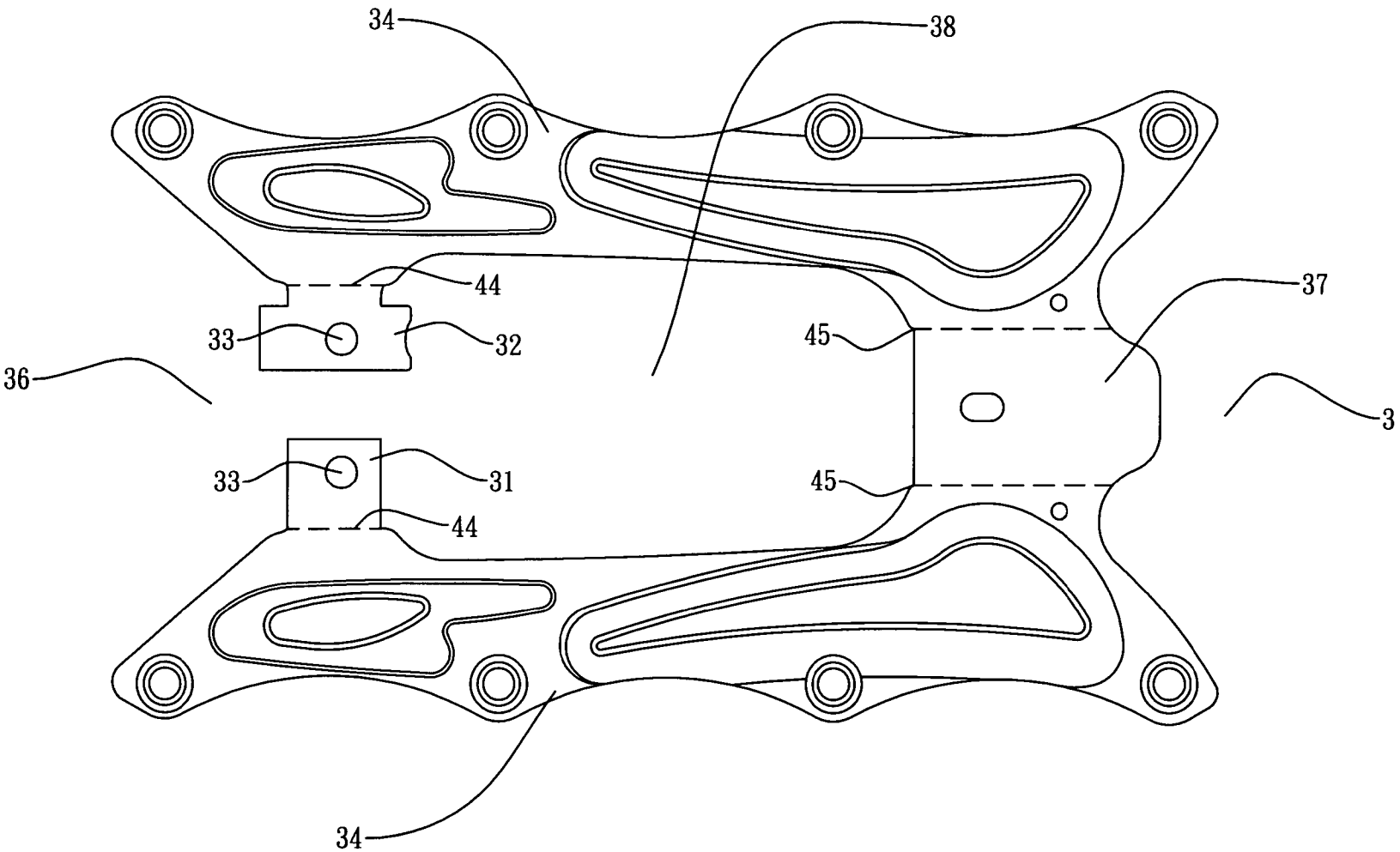
FIG. 4 is an exploded view of the roller skate frame according to the preferred embodiment of the present invention.

FIGS. 4 to 8-1 illustrate a preferred embodiment of the roller skate frame of the present invention. The plate mainly composed of light and rigid aluminum is formed by press mold at one time forming the body of the roller skate frame (3). The roller skate frame (3) is provided with two corresponding wheel-mounting plates (34) forming a space (38) with suitable distance between front bottom connecting face (36) and shoe-mounting plate (37) thereof. The front bottom connecting face (36) is provided by the corresponding upper and lower bridging plates (32, 31) with being suitably spaced apart, and each of which has a fastener hole (33) on it.

Figure 5:
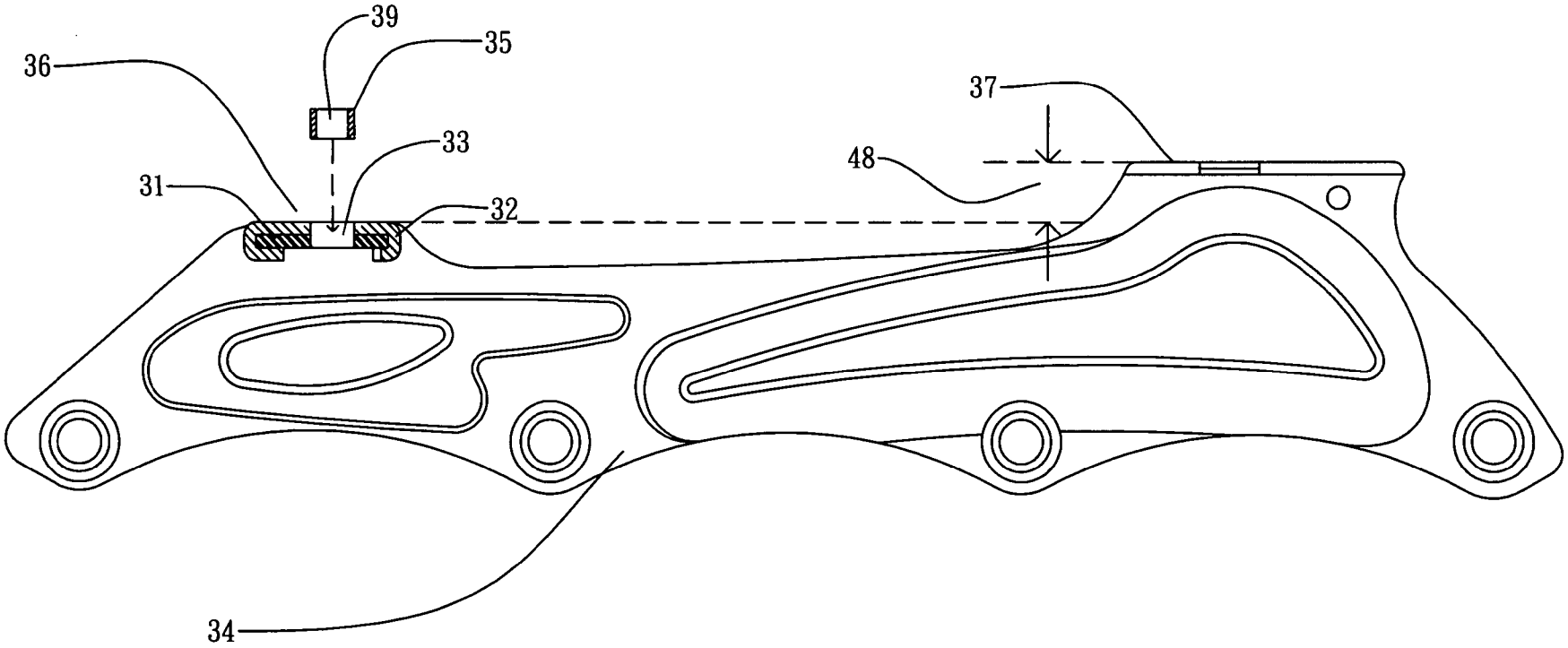
FIG. 5 is a side view illustrating the bended roller skate frame according to the preferred embodiment of the present invention.
Figure 6:
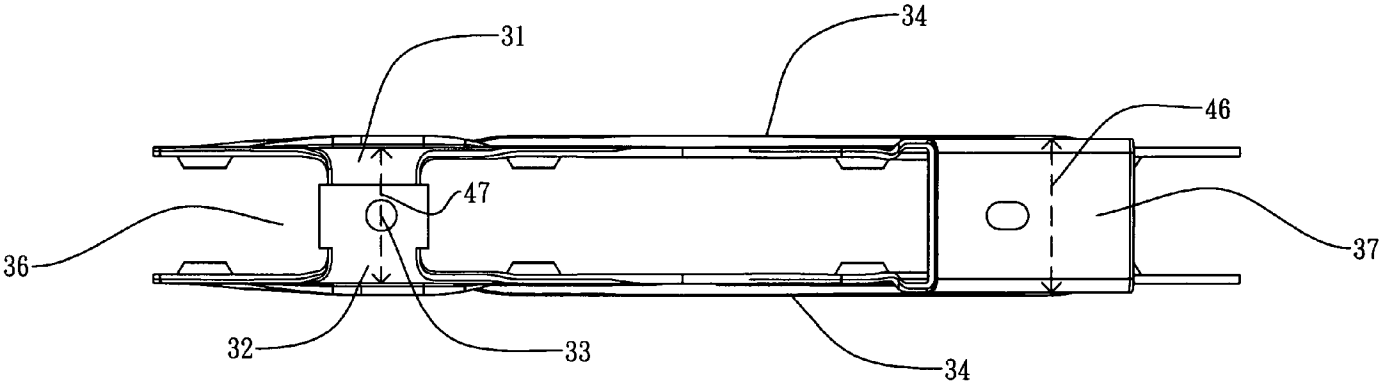
FIG. 6 is a perspective top view of the bended roller skate frame according to the preferred embodiment of the present invention.
Figures 1, 6:
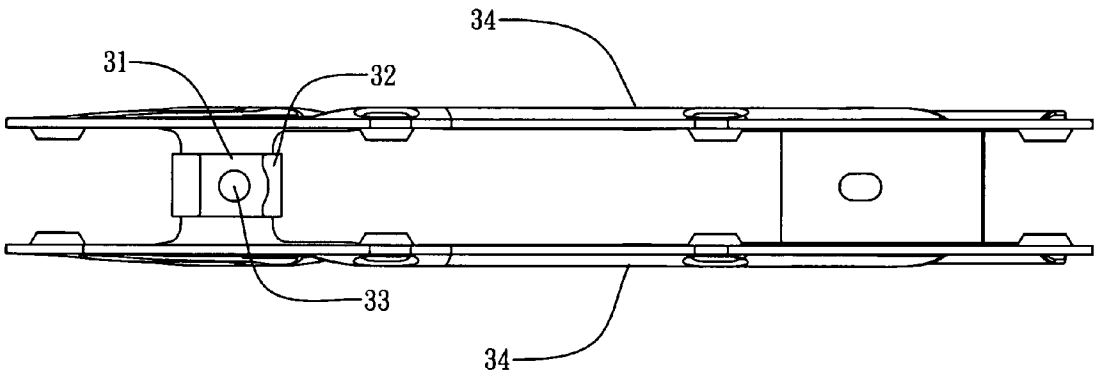

Referring to FIG. 4 and FIGS. 5 to 6-1 which illustrate the wheel-mounting plate (34) being bended, the width of the upper bridging plate (32) is wider than the lower bridging plate (31). When the wheel-mounting plate (34) being bended inwardly with right angle, the upper bridging plate (32) overlaps the lower bridging plate (31) with two fastener holes (33) located corresponding to each other which has a protrusion (35) extending through for fastening. As shown in FIG. 5, comparing to the lower bridging plate (31), the exceeding parts of the upper bridging plate (32) at two ends are allowed to be bended downwardly wrapping over two ends of the lower bridging plate (31). While being bended, the bending lines (44) located between the front inner section of the wheel-mounting plates (34) and upper and lower bridging plates (32, 31) respectively are parallel to the second bending line (45) provided on the rear connecting face (37) of the inner rear section of the wheel-mounting plate (34) without intersection. As shown in FIG. 6, the width (46) provided by suitable space between the overlapping upper and lower bridging plates (32, 31) represents the same width (47) of the shoe-mounting plate (37). As shown in FIG. 5, the height difference (48) is formed between the higher shoe-mounting plate (37) and the lower front bottom connecting face (36).

Figure 7:
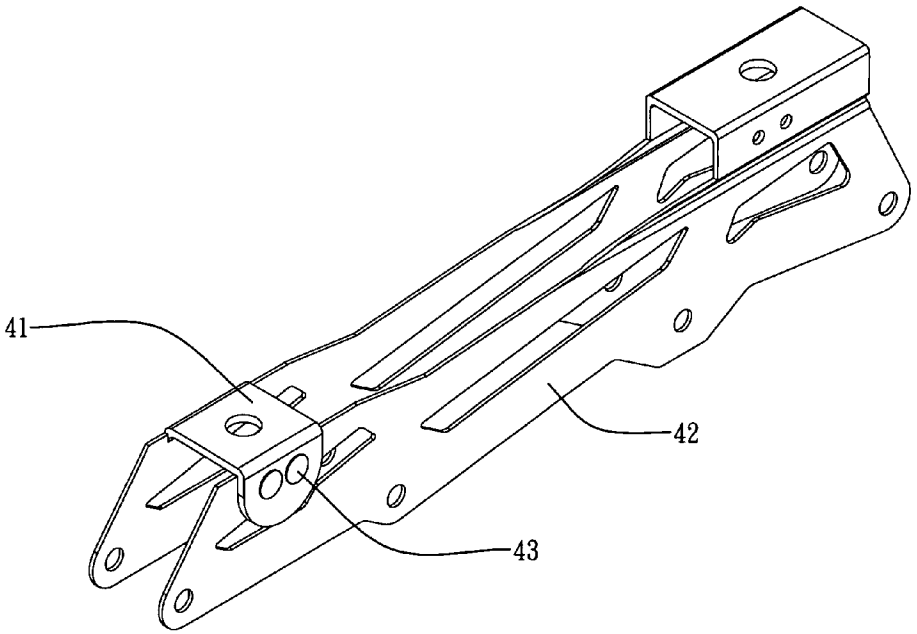
FIG. 7 is a perspective view of the first combination of the bridging plates with the wheel-mounting plates according to the preferred embodiment of the present invention.
Figures 1, 7:
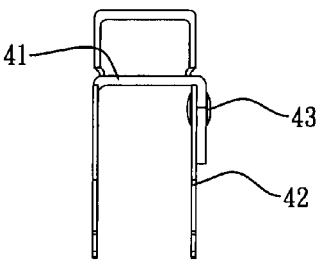
Figure 8:
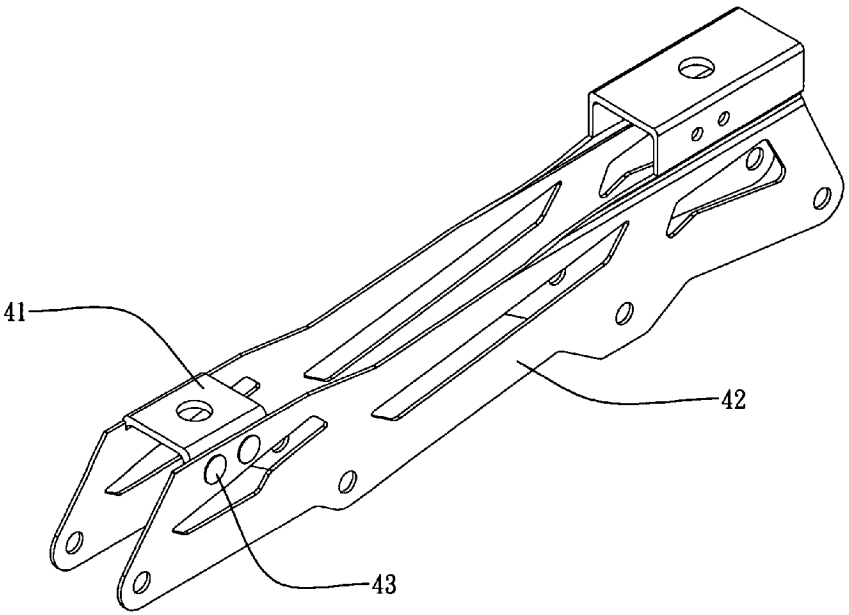
FIG. 8 is a perspective view of the second combination of the bridging plates with the wheel-mounting plates according to the preferred embodiment of the present invention.
Figures 1, 8:
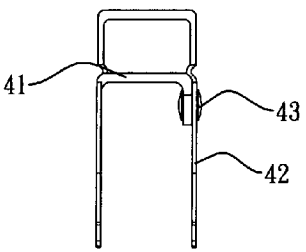

FIGS. 7 and 8 illustrate the second structure example of the present invention. The lower bridging plate (31) and the higher bridging plate (32) can be transformed into one single bridging plate (41), which allows suitably extending from one single side and the extra parts (41) of the bridging plate (41) can be bended downwardly with 90 degrees to cover outside of the wheel-mounting plate (42) as shown in FIG. 7 or lean against the inside wall of the wheel-mounting plate (42) as shown in FIG. 8, and both of which are fastened with a pin (43) respectively.

With the invention thus explained, it is apparent that the plate can be bended into a roller skate frame (3) with different height between the front and rear parts thereof by the pressing mold in one time without equipping other components. Preferably, no other component is needed for forming the shoe-mounting plate (37) which would be formed naturally after being bended to prevent from the waste of the cost and make the best use of the material.

What is claimed is:

1. A roller skate frame comprising:

a pair of wheel-mounting plates corresponding to each other, having a front bottom connecting face connecting said wheel mounting plates at a front end of said wheel-mounting plates; and a shoe-mounting plate connecting said wheel mounting-plates at a rear end of said wheel-mounting plates, said front bottom connecting face and said shoe-mounting plate being spaced apart from each other, said front bottom connecting face formed by an upper bridging plate and a lower bridging plate, each of said upper and lower bridging plates are integral to a corresponding one of the wheel-mounting plates and each provided with a fastener hole, the fastener holes are aligned with one another, when the upper and lower bridging plates overlap each other, so as to allow a protrusion to extend through said fastener holes and fasten said upper and lower bridging plates to each other, said upper bridging plate has at two ends respective extending portions bended downwardly wrapping over two ends of said lower bridging plate, the upper and lower bridging plates are bended with respect to the respective wheel-mounting plates along respective bending lines that are parallel to bending lines positioned between an inner edge of the wheel-mounting plate and the shoe-mounting plate, the overlap between the upper and lower bridging plates allows a width of the front bottom connecting face formed by the overlapped upper and lower bridging plates fastened to each other to be the same as a width of the shoe-mounting plate, and the front bottom connecting face is at a different height from the shoe-mounting plate.

* * * * *